United States Patent [19]

Goto et al.

[11] Patent Number: 4,576,909

[45] Date of Patent: Mar. 18, 1986

[54] SILVER HALIDE COLOR PHOTOGRAPHIC LIGHT-SENSITIVE MATERIAL

[75] Inventors: Sohei Goto; Ken Okauchi, both of Hino, Japan

[73] Assignee: Konishiroku Photo Industry Co., Ltd., Tokyo, Japan

[21] Appl. No.: 657,686

[22] Filed: Oct. 4, 1984

[30] Foreign Application Priority Data

Oct. 5, 1983 [JP] Japan ..... 58-187513

[51] Int. Cl.[4] ..... G03C 7/32

[52] U.S. Cl. ..... 430/546; 430/548; 430/552; 430/553; 430/554; 430/555; 430/556; 430/557; 430/558; 430/637

[58] Field of Search ..... 430/546, 548, 552–558, 430/637

[56] References Cited

U.S. PATENT DOCUMENTS

| | | | |
|---|---|---|---|
| 2,280,722 | 4/1942 | Schneider et al. | 430/548 |
| 3,488,708 | 1/1970 | Smith | 430/637 |
| 4,080,211 | 3/1978 | Van Paesschen et al. | 430/548 |
| 4,284,709 | 8/1981 | Tomka | 430/637 |
| 4,367,283 | 1/1983 | Nakayama et al. | 430/637 |
| 4,478,870 | 10/1984 | Yagihara et al. | 430/548 |

*Primary Examiner*—J. Travis Brown

*Attorney, Agent, or Firm*—Jordan B. Bierman

[57] ABSTRACT

A silver halide color photographic light-sensitive material comprising a support having at least one silver halide emulsion layer in which there is provided a polymer coupler and a compound of the formula $$Ar—O—(RO)_pH \quad [I]$$

wherein Ar is an aryl group, R is an alkylene group, and p is an integer from to 1 to 3.

15 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material, and more particularly to a silver halide color photographic light-sensitive material that is improved on the color developability as well as on the developed image sharpness.

2. Description of the Prior Art

After an imagewise exposure of a silver halide color photographic light-sensitive material, the light-sensitive material is developed by an aromatic primary amine-type developing agent in the presence of a coupler capable of forming a dye by the reaction thereof with the aromatic primary amine-type developing agent, then bleached, and then fixed, whereby a dye image can be formed.

Generally speaking, for the above dye image formation, a negative-positive method is used in which a dye image (negative image) having complementary color relation with a subject is once formed on a negative light-sensitive material, and the negative image is then projected upon a color photographic printing paper to reproduce thereon a dye image (positive image) corresponding to the subject, the dye image having complementary color relation with the negative image.

In recent years, there has been a tendency toward making cameras more compact as well as making a light-sensitive material's processing period shorter. This tendency has now increasingly given rise to the need for producing smaller-size image-photographic (smaller-format) negative-type color photographic light-sensitive materials. The smaller the size of a negative image the larger the increase in the magnification used when projecting the image upon a color photographic printing paper. If a negative is of a graininess that cannot cover the increase in the magnification, the graininess and sharpness produce an image of poor quality, which become a large problem. Many attempts have been and are now being made to improve the graininess and sharpness.

The sharpness can be improved largely by reducing the thickness of the emulsion layer. In order to reduce the thickness, it is necessary to reduce as much as possible the gelatin content of the emulsion layer. However, if the gelatin content is reduced and a high-boiling organic solvent is used as a coupler solvent, a phenomenon called "sweating" tends to occur which is undesirable for the characteristics of the light-sensitive material. The "sweating" is a phenomenon that an oily component oozes out on the surface of a light-sensitive material when the material is placed under a highly moist air condition. The sweating phenomenon can be prevented by the use of a polymer coupler that is obtained by the polymerization of a coupler monomer. That is, the incorporation of a polymer coupler into the emulsion layer enables to prevent the sweatng phenomenon even when the gelatin content of the emulsion layer is reduced, thus accomplishing the thinning of the emulsion layer.

Regarding the polymer coupler, U.S. Pat. Nos. 3,370,952 and 4,080,211 describe methods for producing it by the emulsion polymerization of a monomer coupler; and U.S. Pat. No. 3,451,820 describes a method for dispersing an oleophilic polymer coupler obtained by polymerizing a monomer coupler in the oil droplet from into an aqueous gelatin solution.

Those for cyan polymer couplers are described in U.S. Pat. No. 3,767,412, Japanese Patent Publication Open to Public Inspection (hereinafter referred to as Japanese Patent O.P.I. Publication) Nos. 161541/1981 and 161542/1981, and those for magenta polymer couplers in U.S. Pat. Nos. 3,623,871 and 4,123,281, and Japanese Patent O.P.I. Publication Nos. 94752/1982, 28745/1983 and 120252/1983.

However, these polymer couplers, although they have the above-mentioned excellent advantages, are disadvantageous in respect that their coupling reaction is so slow that no adequate developed-color density is obtained.

West German Pat. No. 2,725,591, U.S. Pat. No. 3,926,496, and Japanese Patent O.P.I. Publication No. 94752/1982 describe that the use of a two-equivalent magenta polymer coupler latex improves the coupling reactivity. However, the resulting formed color density is still not adequate.

Japanese Patent O.P.I. Publication No. 28745/1983 discloses the incorporation of a water-immiscible high-boiling organic solvent for the purpose of increasing the dispersing stability of a polymer coupler. However, the combined use of a high-boiling solvent known as an ordinary coupler solvent such as dibutyl phthalate, triphenyl-cresyl phosphate, etc., with a polymer coupler may improve slightly but cannot improve adequately the formed color density.

OBJECTS OF THE INVENTION

It is, therefore, a first object of the present invention to provide a silver halide color photographic light-sensitive material which is improved on the sharpness as well as on the color formability.

It is a second object of the present invention to provide a silver halide color photographic light-sensitive material whose emulsion layers are coated so thin that an excellent sharpness is obtained.

It is a third object of the present invention to provide a high-speed silver halide color photographic light-sensitive material which contains polymer couplers.

CONSTRUCTION OF THE INVENTION

As a result of our investigation it has now been found that the objects of the present invention can be accomplished by the following light-sensitive material: In a silver halide color photographic light-sensitive material comprising a support having thereon at least one silver halide emulsion layer, the silver halide color photographic light-sensitive material wherein the at least one silver halide emulsion layer contains a polymer coupler and a compound having the following general formula:

Formula [I]

$$Ar\text{-}(O\text{—}RO)_pH$$

wherein Ar is an aryl group, R is an alkylene group, and p is an integer of from 1 to 3.

That is, the present invention is such that the combined use of a compound having the above formula with a polymer coupler makes the most of the advantage of and covers the disadvantage of the polymer coupler to thereby produce a high-speed silver halide color photographic light-sensitive material having excellent image sharpness, high formed-color density, and small fog.

EFFECTS OF THE INVENTION

The combined use of polymer couplers and Compound [I] enables to accomplish the improvement on the image sharpness by thinning the emulsion layers, the decrease in fog, and the increase in the color density and speed simultaneously, and also enables the well-balanced improvement of the reciprocal photographic characteristics.

DETAILED DESCRIPTION OF THE INVENTION

The present invention will be illustrated further in detail.

The polymer coupler used in the present invention is obtained by polymerizing a coupler monomer.

The preferred yellow coupler monomers are those having the following Formula [II]; the preferred cyan coupler monomers are those having the following Formula [III] or [IV]; and the preferred magenta coupler monomers are those having the following Formula [V].

Formula [II]: yellow coupler monomer

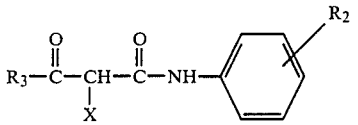

(b)

wherein $R_2$ is a hydrogen atom or an alkyl or alkoxy group having from 1 to 4 carbon atoms, a halogen atom, a sulfo, carboxy, sulfonamido, carbamoyl, sulfamoyl or cyano group; $R_3$ is an alkyl or aryl group; X is a group that splits off during the coupling reaction with the oxidized product of an aromatic primary amine developing agent, the X being such as a hydrogen atom, or a halogen atom, or an aryloxy, carbamoyloxy, carbamoylmethoxy, acyloxy, sulfonamido or succinic acid imido group which are combined by an oxygen atom or a nitrogen atom directly to the coupling position. In addition, those split-off groups other than the above may also be used which are described in U.S. Pat. No. 3,471,563, Japanese Patent Examined Publication No. 36894/1973, Japanese Patent O.P.I. Publication Nos. 374125/1972, 10135/1975, 117422/1975, 130441/1975, 108841/1976, 120334/1975, 18315/1977, 52423/1978, 105226/1978, and the like.

Said yellow coupler monomer represented by the Formula [II] has, in an arbitrary position thereof, at least one group containing polymerizable vinyl group. Said group is preferably substituted at $R_3$ or phenyl group having $R_2$ of the Formula [II]. Said group containing polymerizable vinyl group preferably has the following Formula:

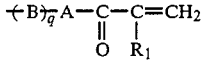

wherein $R_1$ is a hydrogen atom or a methyl group; A is a divalent group of —NH or —O—; B is a divalent organic group; and q is 0 or 1.

Formula [III]: cyan coupler monomer

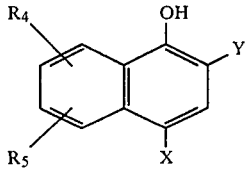

Formula [IV]

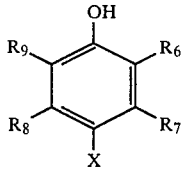

In Formula [III] $R_4$ and $R_5$ are the same as the $R_1$ and $R_2$, respectively, in Formula [II]; X is as defined in Formula [II]; Y is a group containing a polymerizable vinyl group. Y preferably has the following formula:

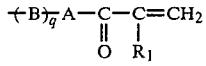

wherein $R_1$ is a hydrogen atom or a methyl group; A is a divalent group of —NH or —O—; B is a divalent organic group; and q is 0 or 1.

More preferably Y has the following formula:

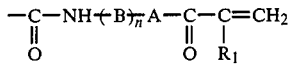

wherein B, A, $R_1$ and n are as defined above.

In Formula [IV], $R_7$ and $R_9$ are the same as the $R_1$ and $R_2$, respectively, of Formula [II]; X is as defined in Formula [II]; and $R_6$ and $R_8$ each is a hydrogen atom, an alkyl or alkoxy group having from 1 to 8 carbon atoms, a halogen atom, a sulfo, carbamoyl, carboxy or sulfamoyl group, or a —NH—L group wherein L is alkylcarbonyl, arylcarbonyl, alkylsulfonyl, aryl sulfonyl or alkoxycarbonyl group, acryloylamino, methacryloylamino, acryloyloxy or methacryloyloxy group, provided that at least one of $R_6$ and $R_8$ is a group containing a polymerizable vinyl group. Said group containing a polymerizable vinyl group is preferably one having following formula:

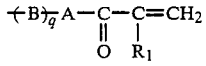

wherein $R_1$ is a hydrogen atom or a methyl group; A is a divalent group of —NH or —O—; B is a divalent organic group; and q is 0 or 1.

Formula [V]: magenta coupler monomer

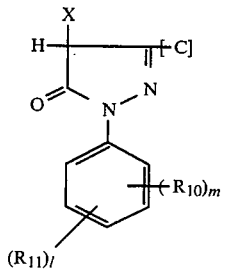

wherein X is as defined in Formula [II]; $R_{10}$ is the same as the $R_2$ of Formula [II]; $R_{11}$ is as defined in the $R_6$ or $R_8$ of Formula [IV]; C is as defined in the $R_6$ or $R_8$ of Formula [IV] or

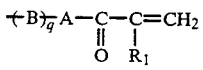

(preferably

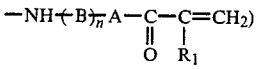

wherein $R_1$, A and B are as defined in Formula [III]; and m and l each is an integer of up to 3. In Formula [V], at least one of the [C] and $R_{11}$ must have a group containing a polymerizable vinyl group.

The B defined above include an alkylene group having from 1 to 12 carbon atoms, an arylene group having from 6 to 12 carbon atoms, an arylene-alkylene group having from 7 to 24 carbon atoms, an arylene-bisalkylene group having from 8 to 32 carbon atoms or an alkylene-bisarylene group having from 13 to 34 carbon atoms. The following are examples of the coupler monomer and polymer coupler of the present invention. The compounds usable in the present invention are not limited to the following examples.

Exemplified coupler monomers:

(1)

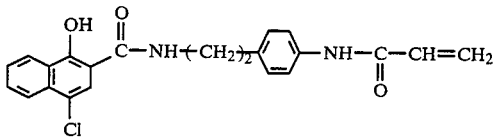

(2)

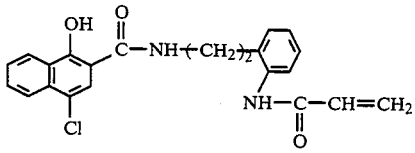

(3)

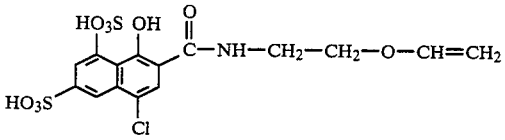

-continued

Exemplified coupler monomers:

(4)

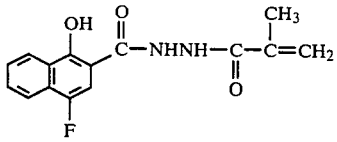

(5)

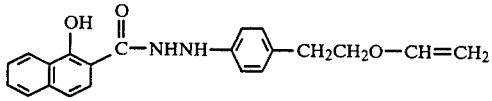

(6)

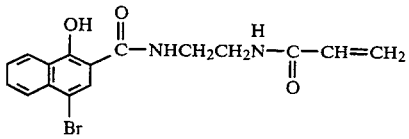

(7)

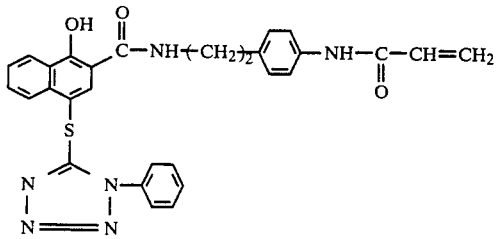

(8)

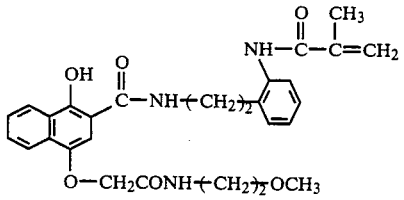

(9)

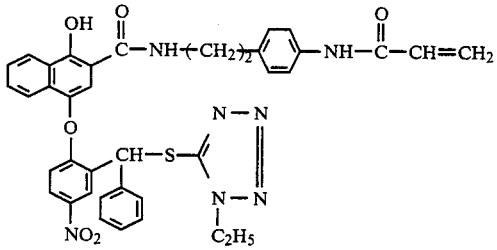

(10)

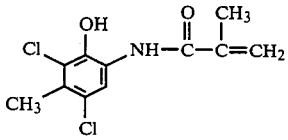

(11)

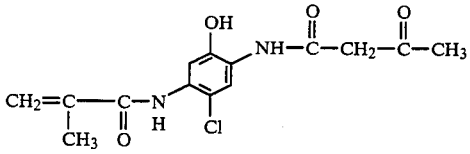

(12)

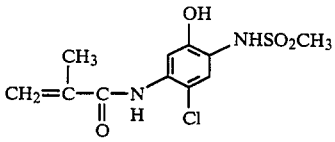

-continued
Exemplified coupler monomers:
(13)
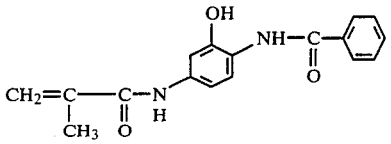
(14)
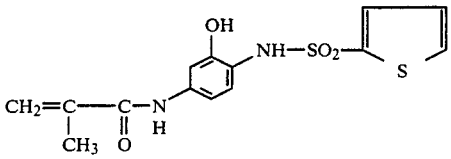
(15)
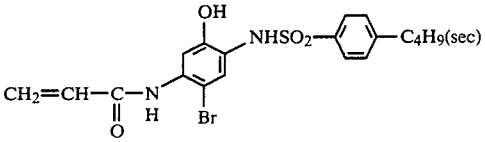
(16)
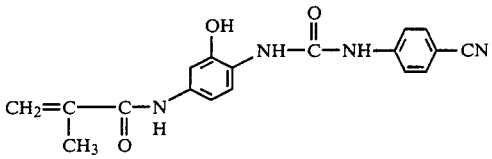
(17)
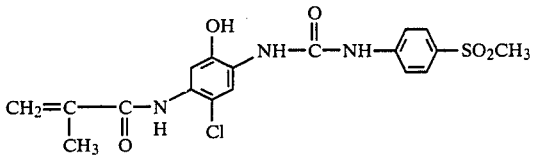
(18)
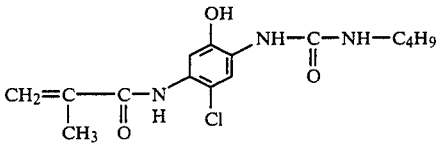
(19)
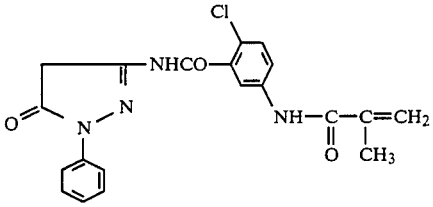
(20)
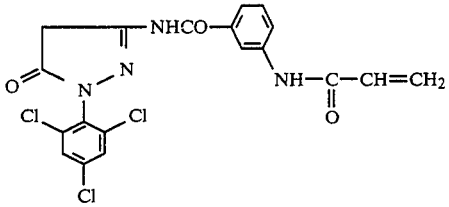
(21)
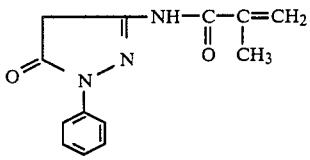
-continued
Exemplified coupler monomers:
(22)
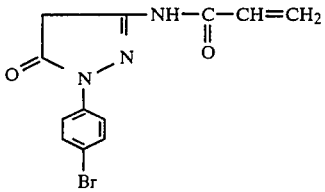
(23)
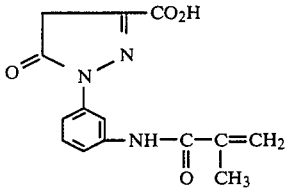
(24)
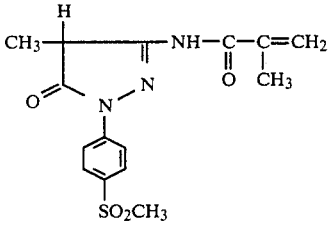
(25)
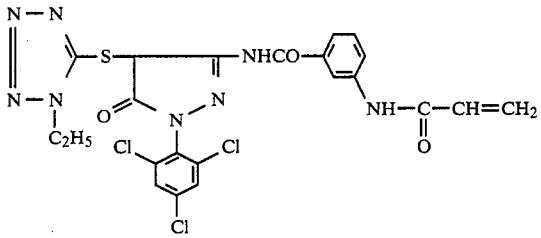
(26)
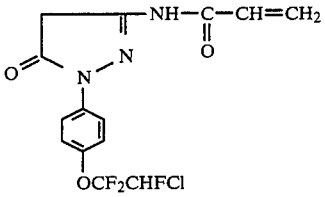
(27)
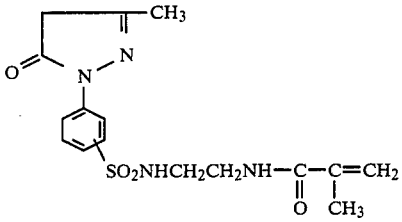
(28)
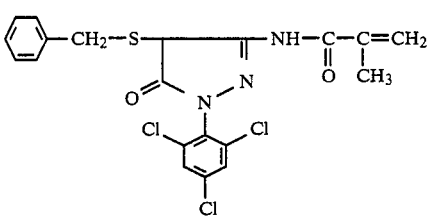

-continued
Exemplified coupler monomers:
(29)
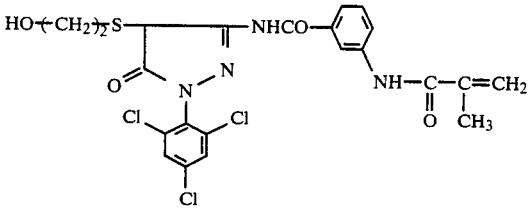
(30)
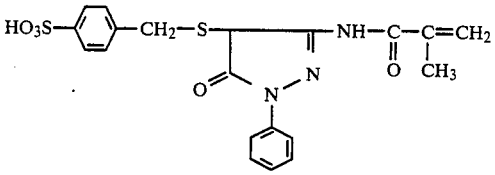
(31)
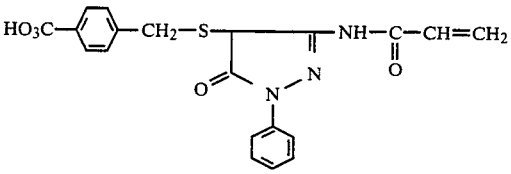
(32)
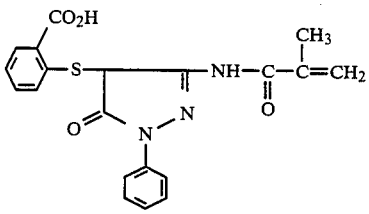
(33)
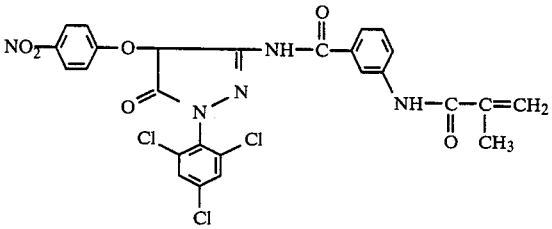
(34)
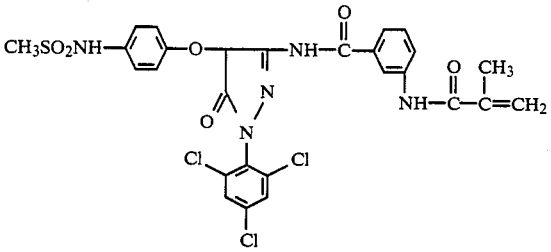
(35)
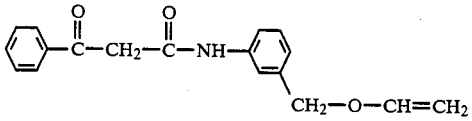
-continued
Exemplified coupler monomers:
(36)
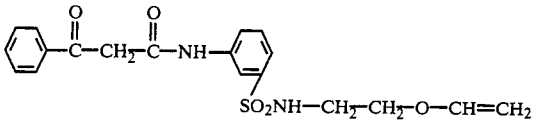
(37)
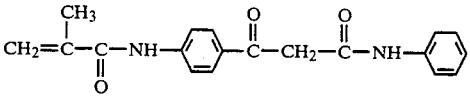
(38)
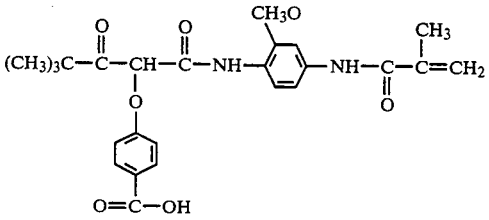
(39)
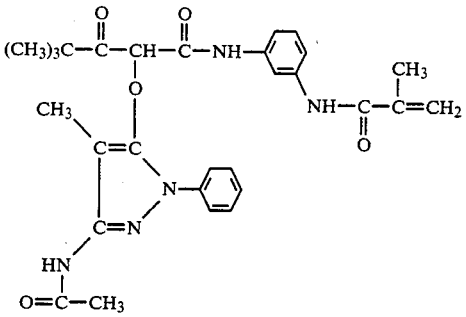
(40)
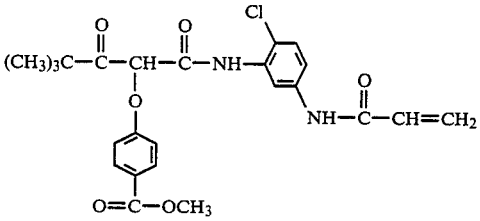
(41)
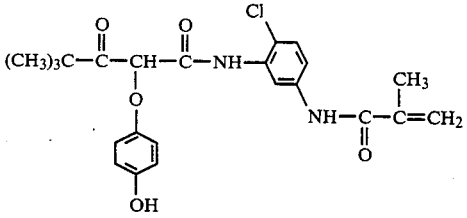
(42)
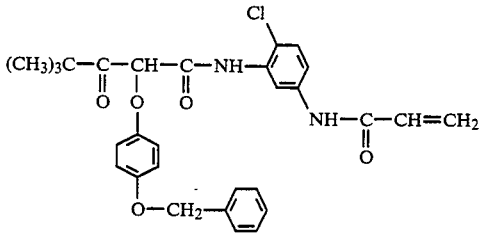

-continued

Exemplified coupler monomers:

(43)

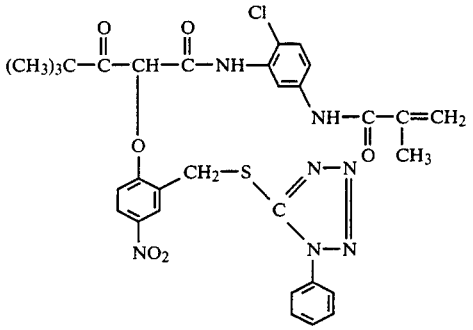

(44)

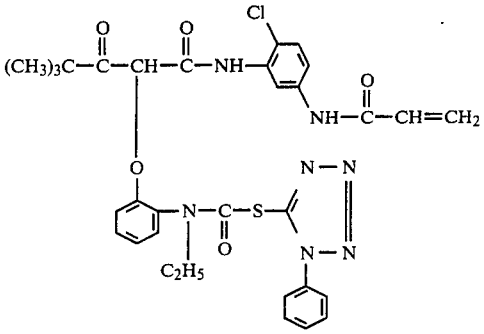

Subsequently, examples of the polymer coupler latex of the present invention, which are obtained from the above coupler monomers, are given below. The present invention is not limited by the following examples.

Exemplified polymer couplers:

(P-1)

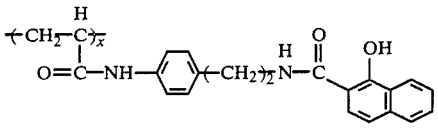

x = 60% by weight

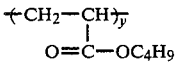

y = 40% by weight (P-2)

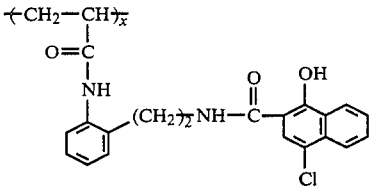

x = 70% by weight

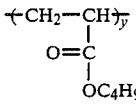

y = 20% by weight

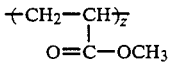

x = 10% by weight

-continued

Exemplified polymer couplers:

(P-3)

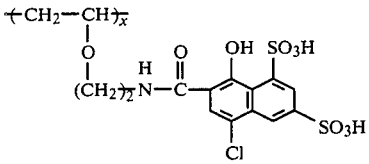

x = 80% by weight

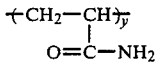

y = 20% by weight (P-4)

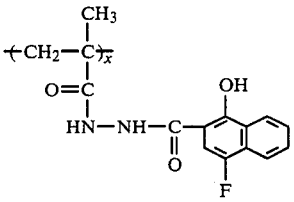

x = 90% by weight

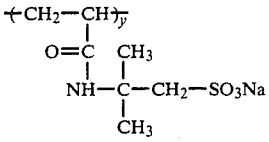

y = 5% by weight

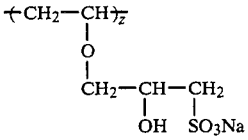

x = 5% by weight (P-5)

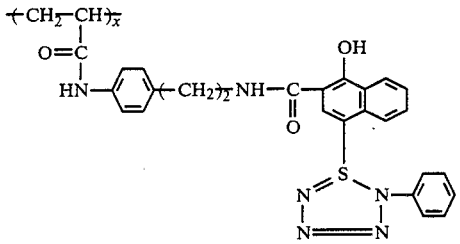

x = 60% by weight

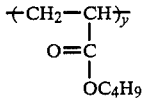

y = 40% by weight (P-6)

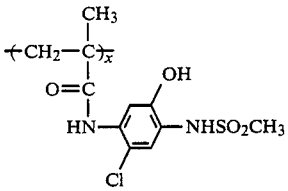

x = 100% by weight (P-7)

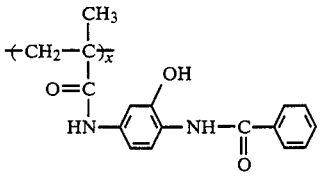

x = 100% by weight

-continued
Exemplified polymer couplers:
(P-8)
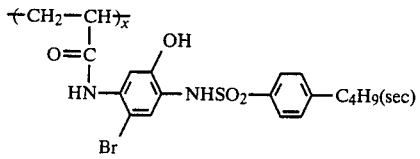
x = 65% by weight
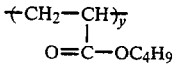
y = 35% by weight
(P-9)
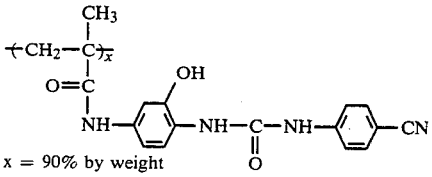
x = 90% by weight
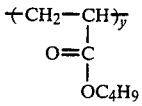
y = 10% by weight
(P-10)
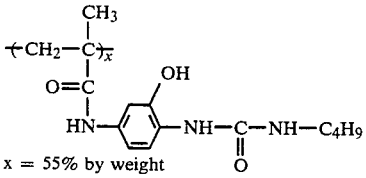
x = 55% by weight
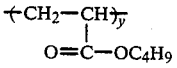
y = 45% by weight
(P-11)
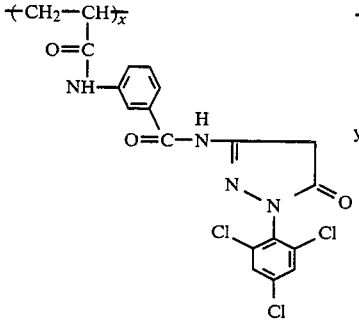
x = 80% by weight
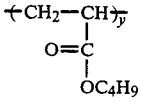
y = 20% by weight
(P-12)
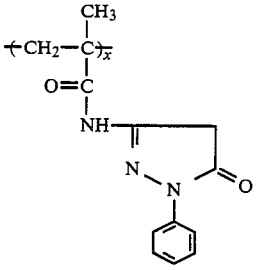
x = 100% by weight
-continued
Exemplified polymer couplers:
(P-13)
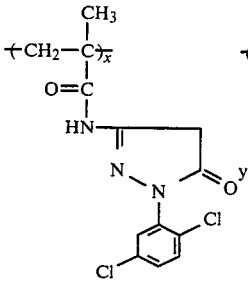
x = 85% by weight
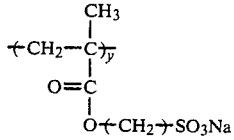
y = 5% by weight
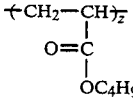
z = 10% by weight
(P-14)
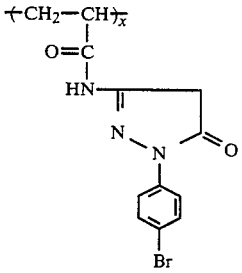
x = 100% by weight
(P-15)
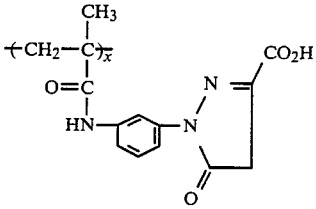
x = 70% by weight
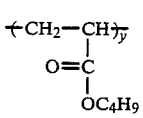
y = 30% by weight
(P-16)
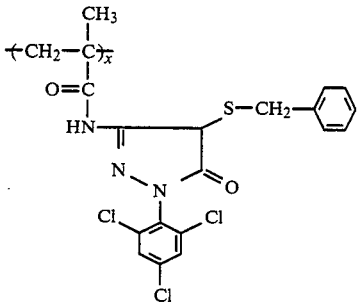
x = 80% by weight
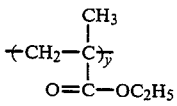
y = 15% by weight
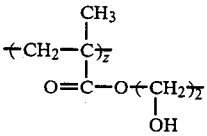
z = 5% by weight -continued
Exemplified polymer couplers:
(P-17)
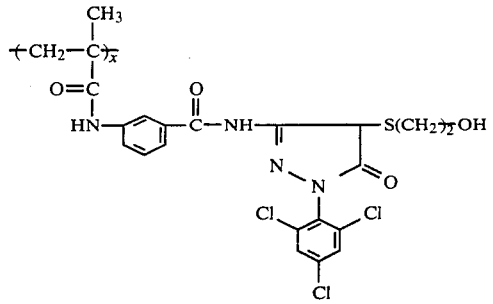
x = 80% by weight
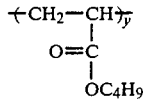
y = 20% by weight
(P-18)
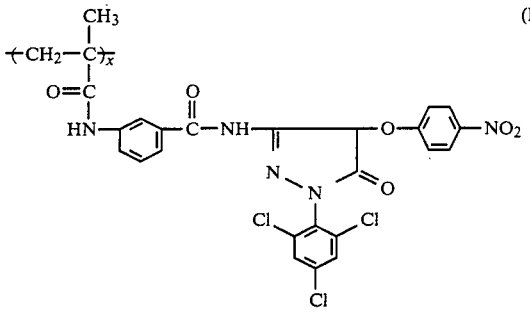
x = 70% by weight
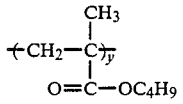
y = 30% by weight
(P-19)
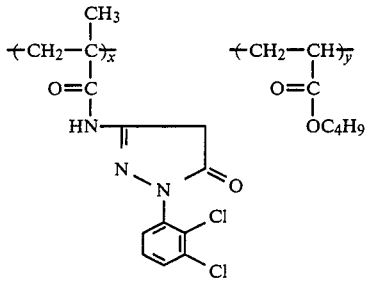
x = 70% by weight y = 30% by weight
(P-21)
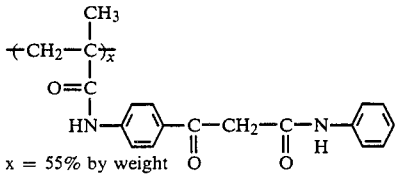
x = 55% by weight
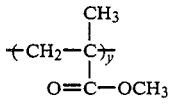
y = 45% by weight
-continued
Exemplified polymer couplers:
(P-21)
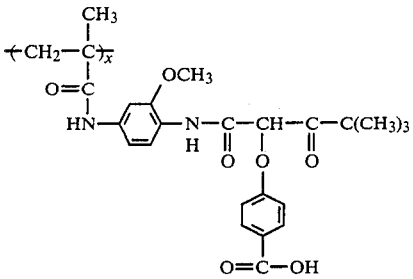
x = 90% by weight
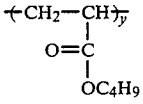
y = 10% by weight
(P-22)
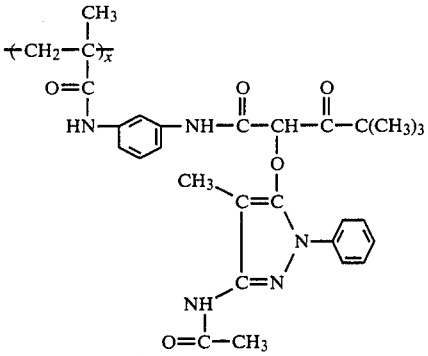
x = 95% by weight
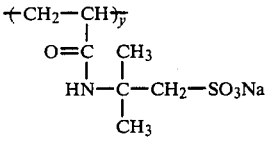
y = 5% by weight
(P-23)
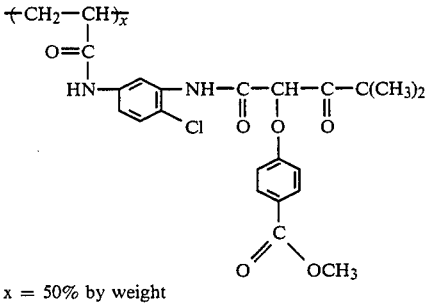
x = 50% by weight
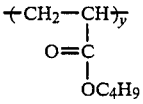
y = 50% by weight -continued Exemplified polymer couplers:

(P-24)

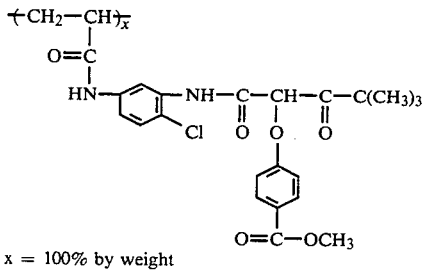

x = 100% by weight (P-25)

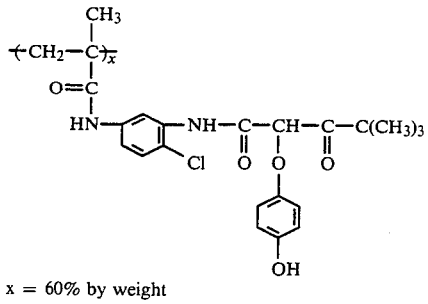

x = 60% by weight

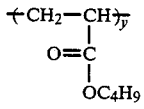

y = 40% by weight (P-26)

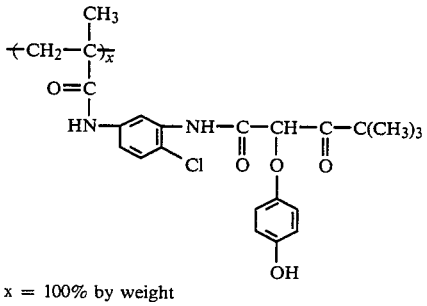

x = 100% by weight (P-27)

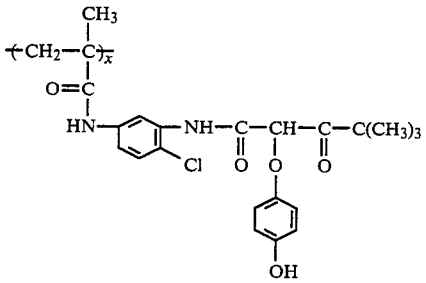

x = 70% by weight

-continued

Exemplified polymer couplers:

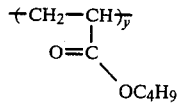

y = 25% by weight

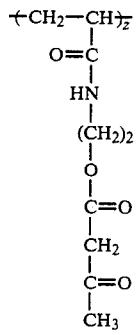

z = 5% by weight

POLYMERIZATION REACTION EXAMPLE 1

(Exemplified Polymer Coupler (P-1) Compound)

Two grams ($5.55\times10^{-3}$ mole) of 4-[2-(1-hydroxy-2-naphthoylamino)ethyl]acryloylanilide {Exemplified Coupler Monomer (1)} and 2 g (0.016 mole) of n-butyl acrylate were dissolved by heating into 40 ml of deaired-by-$N_2$-gas dioxane. To the solution, with stirring under a $N_2$ gas flow, were added 70 mg ($4.26\times10^{-4}$ mole) of azoisobutyronitrile. After the addition of the azoisobutyronitrile, the reaction of the mixture kept at 60° C. took place over a period of 24 hours. After the reaction, 10–20 ml of dioxane were added to dilute the reaction liquid. The liquid was then poured into 600 ml of distilled water, and to this was then added sodium chloride. The liquid was allowed to stand overnight. The deposited yellow precipitate was filtered and then dried under reduced pressure, whereby 3.6 g of a polymer coupler were obtained.

The molecular weight of the obtained polymer coupler determined by the gel permeation chromatography method was 4200 in terms of number average molecular weight and was $6\times10^4$ (polystyrene equivalent) in terms of weight average molecular weight.

The percentage of the coupler monomer contained in the polymer determined by elementary analysis was 49.2% by weight.

POLYMERIZATION REACTION EXAMPLE 2

{Exemplified Polymer Coupler (P-6)}

Twenty-five grams (0.10 mole) of 2-methyl-sulfonylamino-4-chloro-5-methacryloylaminophenol {Exemplified Coupler Monomer (12)} and 20 ml of an aqueous 30% Trax H 45 (manufactured by Nippon Oils & Fats Co., Ltd.) solution were mixed into 500 ml of deaired-by-$N_2$-gas water, and the mixture was stirred for two hours at a temperature of from 50° C. to 60° C. The reaction liquid was then heated to 80° C., and to this were added 11 ml ($1.67\times10^{-3}$ mole) of an aqueous 5% sodium 4,4'-azobis-4-cyano-valerate solution. The liquid was stirred, keeping the inside temperature at 80° C., for 5 to 6 hours. After completion of the reaction, the aggregate was filtered off, and the filtered liquid was put in a dialysis tube. The tube was allowed to stand in distilled water for three days. After completion of the reaction, the aggregate was filtered off, and the filtered liquid was put in a dialysis tube. The tube was allowed to stand in distilled water for three days. The liquid was then refined by ultrafiltration with use of a filter (Toyo Ultrafilter UK-10) for differential molecular weight of $1\times10^4$, whereby a stable latex liquid of 35% solid concentration was obtained, which was confirmed to be a monodispersed latex liquid whose latex particle size is 0.05μ as a result of observing through an electron microscope. This was found out by gel permeation chromatography to be a polymer coupler having a number average molecular weight of 7800 and weight average molecular weight of $1.3\times10^5$ (polystyrene equivalent).

POLYMERIZATION REACTION EXAMPLE 3

{Exemplified Polymer Coupler (P-11) Compound}

Four milliliters of an aqueous 10% oleoylmethyl tauride (Diapon T, manufactured by Nippon Oils & Fats Co., Ltd.) solution were added through a measuring pipet to 190 ml of diaired-by-$N_2$-gas water. The solution was stirred at an inside temperature of 80° C. by means of a mechanical stirrer at a rate of 230 r.p.m. To this were added 40 mg of potassium persulfate (dissolved in 5 ml of deaired water). One minute after completion of the addition of the potassium persulfate, to the liquid a solution prepared by dissolving by heating 2 g ($4.42\times10^{-3}$ mole) of 1-(2,4,6-trichlorophenyl)-3-(3-acryloylaminobenzamido)-2-pyrazoline-one {Exemplified Coupler Monomer (20)} and 2 g (0.0156 mole) of n-butyl acrylate into 5 ml of ethanol was added dropwise, spending about 30 minutes so as not to cause the monomer to deposit.

After the dropping of the monomer, the reaction of the liquid took place by heating to 80° C. for a period of 3 hours. After that, the oil bath was heated to 90°–95° C. to distill off the ethanol and the unreacted n-butyl acrylate through the equipped distilling tube. After completion of the reaction, the liquid's pH was adjusted by use of an aqueous 5% $Na_2CO_3$ solution to 6.0. The liquid was then refined by ultrafiltration using a filter (Toyo Ultrafilter UP-20) for a differential molecular weight of $2\times10^4$ to thereby obtain a polymer coupler latex liquid of a solid concentration of 10.1% by weight. The obtained polymer coupler was determined by gel permeation chromatography to be of a number average molecular weight of 8000 and of a weight average molecular weight of $2.3\times10^5$ (polystyrene equivalent). The coupler monomer content percentage of the polymer was calculated by elementary analysis to be 50.5% by weight.

The polymer coupler of the present invention is desirable to be added to a silver halide emulsion layer. The preferred examples of the addition of the polymer coupler are as follows: For a polymer coupler latex obtained by the emulsion polymerization method, it may be incorporated, as it is, by mixing into a silver halide emulsion. For a polymer coupler obtained by the solution polymerization method, the coupler is first dispersed by any of dispersing methods known as the generally used photographic coupler dispersing method such as the aqueous alkaline solution dispersing method, solid dispersing method, latex dispersing method, oil-in-water-type emulsifying-dispersing method, and the like. The dispersed liquid is then mixed to be incorporated into a silver halide emulsion. The above polymer coupler latex obtained by the emulsion polymerization is also allowed to be treated in the manner that it is once precipitated by the addition of methanol, etc.; the precipitate is redispersed by any of the above-mentioned dispersing methods; and the dispersed liquid is then added to a silver halide emulsion.

The adding amount of the polymer coupler of the present invention is preferably from 0.005 to 0.5 mole, and more preferably from 0.05 to 0.3 mole per mole of the silver halide of a silver halide emulsion layer.

The polymer coupler of the present invention may be used in combination with any of generally known photographic couplers as described below:

The combinedly usable, preferred photographic cyan couplers are phenol-type and naphthol-type compounds which can be selected from those described in U.S. Pat. Nos. 2,369,929, 2,434,272, 2,474,293, 2,895,826, 3,253,924, 3,034,892, 3,311,476, 3,386,301, 3,419,390, 3,458,315, 3,476,563, 3,591,383, and the like. Synthesis examples of these compounds are also described in these publications.

The combinedly usable photographic magenta couplers include pyrazolone-type, pyrazolotriazole-type, pyrazolinobenzimidazole-type and indazolone-type compounds. The pyrazolone-type magenta couplers are those compounds as described in U.S. Pat. Nos. 2,600,788, 3,062,653, 3,127,269, 3,311,476, 3,419,391, 3,519,429, 3,558,318, 3,684,514, 3,888,680, Japanese Patent O.P.I. Publication Nos. 29639/1974, 111631/1974, 129538/1974, 13041/1975, Japanese Patent Examined Publication Nos. 47167/1978, 10491/1979 and 30615/1980. The pyrazolotriazole-type magenta couplers are those described in U.S. Pat. No. 1,247,493. As the usable nondiffusible colored magenta couplers, those compounds obtained by the substitution of arylazo in the coupling position of colorless magenta couplers are generally used, which include those described in U.S. Pat. Nos. 2,801,171, 2,983,608, 3,005,712, 3,684,514, British Pat. No. 937,621, Japanese Patent O.P.I. Publication Nos. 123625/1974, and 31448/1974. Further, as described in U.S. Pat. No. 3,419,391, those colored magenta couplers of the type whose dye flows out into the processing liquid during the reaction thereof with the oxidized product of a developing agent can also be used.

The combinedly usable yellow couplers include conventional photographic yellow couplers which are open-chain ketomethylene compounds. Those generally extensively used benzoylacetanilide-type yellow couplers and pivaloylacetanilide-type yellow couplers may be used. Further, two-equivalent-type yellow couplers, the carbon atom in the coupling position of which is substituted by a substituent that can be split off during the coupling reaction, can also be used advantageously. Examples of these couplers and their syntheses are described in U.S. Pat. Nos. 2,875,057, 3,265,506, 3,664,841, 3,408,194, 3,277,155, 3,447,928, 3,415,652, Japanese Patent Examined Publication No. 13576/1974, Japanese Patent O.P.I. Publication Nos. 29432/1973, 66834/1973, 10736/1974, 122335/1974, 28834/1975, 132926/1975, and the like.

The using amount of the above nondiffusible couplers is normally from zero to $1\times10^{-1}$ moles per mole of the silver of a light-sensitive silver halide emulsion layer.

For the dispersion of the above couplers various methods may be used which include the aqueous alkaline solution dispersing method, solid dispersing method, latex dispersing method, oil-in-water-type emulsifying-dispersing method, and the like. These methods may be arbitrarily selected according to the chemical structure of the coupler used.

In the present invention, the latex dispersing and oil-in-water-type emulsifying-dispersing methods are particularly useful. These dispersing methods have been well-known. The latex dispersing method and its effects are described Japanese Patent O.P.I. Publication Nos. 74538/1974, 59943/1976 and 32552/1979; and Research Dislosure No. 14850, pp. 77–779, August 1976.

The suitable latex includes homopolymers, copolymers and terpolymers of monomers such as styrene, ethyl acrylate, butyl acrylate, butyl methacrylate, 2-acetacetoxyethyl methacrylate, 2-(methacryloyloxy)ethyl-trimethylammonium metasulfate, sodium 3-(methacryloyloxy)propane-1-sulfonate, N-isopropylacrylamide, N-[2-(2-methyl-4-oxopentyl)]acrylamide, 2-acrylamido-2-methylpropanesulfonate, and the like.

To the oil-in-water-type emulsifying-dispersing method may be applied the conventionally known method for dispersing hydrophobic additives such as couplers. That is, the method is such that a coupler is dissolved into a single or mixture solvent comprising a high-boiling organic solvent whose boiling point is not less than 175° C., such as tricresyl phosphate, dibutyl phthalate, etc., and/or a low-boiling organic solvent such as ethyl acetate, butyl propionate, etc.; the solution is then mixed with an aqueous gelatin solution containing a surface active agent; this mixture is then emulsified to be dispersed by means of either a high-speed rotary mixer or colloid mill; and the dispersed liquid is then either directly or, after removing the low-boiling solvent from the dispersed liquid by a known method, added to a silver halide emulsion.

The colorless coupler usable in the present invention may be selected from those described in British Pat. Nos. 861,138, 914,145 and 1,109,963; Japanese Patent Examined Publication No. 14033/1970; U.S. Pat. No. 3,580,722; and the "Mitteilungen aus dem Forschungs Laboratorien der Agfa Leverkusen" vol. 4, pp. 352–376, 1964; and the like.

The compounds having Formula [I], usable in the present invention, will be further illustrated in detail below.

Formula [I]

$$Ar—O—RO)_pH$$

wherein Ar is an aryl group such as phenyl, $\alpha$ or $\beta$-naphthyl group, etc., or an aryl group having one or more substituents, the substituent being selected from the class consisting of alkyl, alkoxy, alkoxycarbonyl, acylamino, alkylcarbamoyl, alkylsulfonamido, alkylthio, cyano and nitro groups, and a halogen atom; preferred as the Ar is a nonsubstituted phenyl or phenyl at least one of the ortho positions of which is substituted by an alkyl group having from 1 to 4 carbon atoms, an alkoxyl group having from 1 to 4 carbon atoms, a halogen atom, or the like; R is an alkylene group, preferably, methylene, ethylene, propylene or butylene group, and most preferably an ethylene group; and p is an integer of from 1 to 3.

The following are examples of those represented by Formula [I]. The present invention is not limited by the following examples.

Exemplified compounds:

S-1

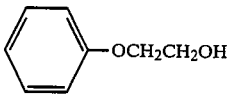

-continued

S-2

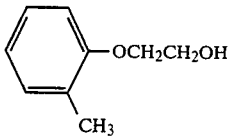

S-3

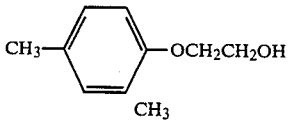

S-4

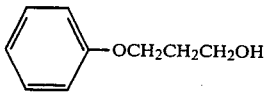

S-5

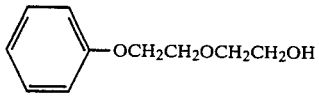

S-6

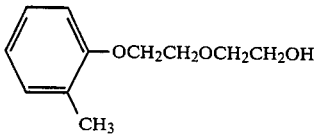

S-7

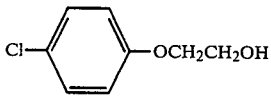

S-8

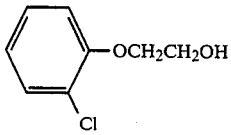

S-9

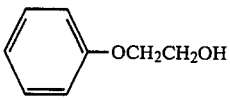

S-10

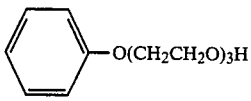

S-11

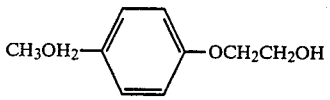

S-12

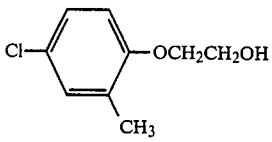

S-13

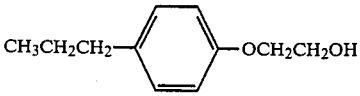

The above compunds of the present invention may be synthesized in accordance with the method described by Rindfusz in J. Am. Chem. Soc., vol. 41, p. 669 (1919).

The compound having Formula [I] of the invention (hereinafter referred to as Compound [I]) is to be added to a silver halide emulsion layer containing a polymer coupler. The adding amount of Compound [I] in proportion by weight to the polymer coupler is preferably from 0.05 to 2.0, and more preferably from 0.1 to 1.0.

The addition of Compound [I] may be carried out in the manner that hydrohobic compounds comprising a single or plural oil-soluble couplers, the foregoing polymer coupler, ultra-violet absorbing agent, oxidation inhibitor, sensitizing dye, hardening agent, and the like, are dissolved together with Compound [I] into a solvent; the solution is then dispersed by means of a dispersing machine such as a colloid mill into an aqueous gelatin solution containing a surface active agent of the prior art; and the dispersed liquid is then incorporated into an emulsion.

Further, a low-boiling organic solvent such as ethyl acetate, butyl acetate, ethyl propionate, or the like, may be used together as an auxiliary solvent for the dispersion.

As the above-mentioned surface active agent, for example, an anionic surface active agent such as an alkylbenzene-sulfonate, alkylnaphthalene-sulfonate, or the like, and/or a nonionic surface active agent such as a sorbitansesquioleate, sorbitanmonolaurte, or the like, may be used.

The silver halide emulsion used for the silver halide photographic light-sensitive material of the present invention can be any of arbitrary silver halide emulsions used by those in the art. The emulsion may contain single silver halide crystal particles or a mixture of different silver halide crystal particles such as of silver chloride, silver bromide, silver iodobromide, silver chlorobromide, silver chloroiodide, silver chloroiodobromide, and the like. The silver halide emulsion may be of either a large or small particle size, and either monodispersed or polydispersed particles. The silver halide may be of a cubic or octahedral crystal, or of an epitaxial composite crystal.

Any of the above emulsions containing various silver halide particles may be prepared in any of the manners well-known to those skilled in the art; i.e., the ammoniacal process, neutral process or acid process, from the standpoint of the pH and solubility of an emulsion; the single-jet process, double-jet process or multiple-jet process, chiefly from the stand-point of pAg adjustment; or the core/shell process, conversion process, or the like, from the standpoint of the particle structure; may be used alone or in combination.

In addition, desired particle size-having monodisperse silver halide particles can be obtained by the double-jet process with the pAg kept constant. A high-monodisperse silver halide emulsion can be prepared by the methods described in Japanese Patent O.P.I. Publication No. 48521/1979. The preferred embodiment among them is such that an aqueous potassium-gelatin solution and an aqueous ammoniacal silver nitrate solution are added at a rate varying as the function of time to an aqueous gelatin solution containing a silver halide seed particles to thereby prepare a silver halide emulsion. In this instance, by selecting properly the function of time at the adding speed, pH, pAg, temperature, etc., a highly-monodisperse silver halide emulsion can be obtained.

The monodisperse silver halide emulsion can be suitably used in the present invention because the emulsion improve the graininess of a coated emulsion layer that contains this emulsion, and also improves the image sharpness of other emulsion layers which are behind in time series with respect to exposure or the initiation of development. The preferred monodispersity is of a group of particles having a coefficient of variation of the size distribution of not more than ($s/\bar{r}$) 20%.

The foregoing various emulsions can be either negative-type emulsions or direct positive-type emulsions. For these emulsions, the surface latent image-type emulsion that forms a latent image on the surface of silver halide particles, the internal latent image-type emulsion that forms a latent image inside silver halide particles, or a mixture of the surface latent image-type emulsion and internal latent image-type emulsion may be used.

In this invention, the preferred silver halide emulsion is of silver iodobromide. The preferred particle size of it is from 0.1 $\mu$m to 2.0 $\mu$m.

Further, that the particles are monodisperse and of the core/shell type is advantageous. In the core/shell-type particles, the silver iodide content of the core portion is from 5 to 20 mole %, and preferably from 5 to 15 mole %. The thickness of the shell portion is preferably from the thickness substantially equal to the particle's diameter to that about 1/50 of the particle's diameter. The siliver iodide content of the shell is preferably from zero to 5 mole %.

The above monodisperse emulsion is allowed to be a mixture of not less than two different monodisperse emulsions.

As the binder for the silver halide emulsion layers of the color photographic light-sensitive material of the present invention those conventionally known may be used, which include, for example, gelatin and gelatin derivatives such as phenylcarbamylated gelatin, acylated gelatin, phthalated gelatin, and the like. These binder materials may, if necessary, be used in the form of a compatible mixture of two or more different materials.

The silver halide photographic emulsion, wherein the above silver halide particles are dispersed into a binder liquid, may be sensitized by a chemical sensitizer. The chemical sensitizer advantageously usable in combination with other additives in the present invention is broadly classified into four groups: noble-metallic sensitizers, sulfur sensitizers, selenium sensitizers and reduction sensitizers.

The noble-metallic sensitizer includes gold compounds and other compounds of ruthenium, rhodium, palladium, iridium, platinum, and the like. If a gold compound is used, ammonium thiocyanate or sodium thiocyanate may be additionally used.

The sulfur sensitizer includes active gelatin and other sulfur compounds.

The selenium sensitizer includes active and inert selenium compounds.

The reduction sensitizer includes stannous salts, polyamines, bisalkylaminosulfides, silane compounds, aminoiminomethanesulfinic acid, hydrazinium salts and hydrazine derivatives.

Further, the silver halide may be optically sensitized to any desired wavelength region by single or combined use of cyanine dyes such as monomethine dyes, trimethine dyes, etc., or optical sensitizers such as merocyanine dyes.

The color photographic light-sensitive material of the present invention may, in addition to the aforementioned additives, contain a stabilizer, development accelerator, hardener, surface active agent, antistain agent, lubricant, ultraviolet absorbing agent and various other additives useful for the photographic light-sensitive material.

The silver halide color photographic light-sensitive material of the present invention may be provided with auxiliary layers such as a protective layer, interlayers, filter layers, an antihalation layer, a backing layer, and the like, in addition to the silver halide emulsion layers.

As the support those conventionally known materials such as plastic film, plastic-laminated paper, baryta paper, synthetic paper, and the like, may be selected according to the purpose for which the photographic light-sensitive material is used. These materials as the support are generally subjected to subbing treatment for increasing the adhesion thereof to the photographic emulsion layer.

The component layers of the light-sensitive material of the invention may be coated by any of various coating processes including the dip coating, air-knife coating, and curtain coating processes, or the extrusion coating process by use of a hopper of the type described in U.S. Pat. No. 2,681,294. If desired, double or multiple layers may be simultaneously coated by the process as described in U.S. Pat. No. 2,761,791 and British Pat. No. 837,095.

No special restriction is put on the processing of the color photographic light-sensitive material; any color-developing method can be used. For example, the light-sensitive material of this invention may be processed in any of the typical manners that the light-sensitive material is color-developed, bleach-fixed, and, if necessary, washed and then stabilized; color-developed, bleached and fixed separately, and, if necessary, washed and then stabilized; prehardened, neutralized, color-developed, stop-fixed, washed, bleached, fixed, washed, post-hardened, and then washed; color-developed, washed, additionally color-developed, stopped, bleached, fixed, washed, and then stabilized; the silver developed by color-development is halogenation-bleached, and then the light-sensitive material is again color-developed to increase the amount of the formed dye; and an amplifier agent such as a peroxide or cobalt complex salt is used to process a small amount of silver-containing light-sensitive material.

The usable, typical color developing agents are p-phenylenediamine-type compounds.

The color developing agent is allowed to be incorporated into the color photographic light-sensitive material of this invention. As the precursor of the color developing agent usable in this invention there may be used those Schiff's base-type precursors of color-developing agents as described in U.S. Pat. Nos. 2,507,114, 2,695,234 and 3,342,599; Research Disclosure vol. 151, No. 15159, November 1979; and those as described in Research Disclosure vol. 129, No. 12924, October 1976, vol. 121, No. 12146, June 1979, and vol. 139, No. 13924, November 1975; and the like.

A color developing solution used in this invention may, if necessary, contain various additives.

EXAMPLES

The present invention will be illustrated by the following examples, but is not limited thereto.

EXAMPLE-1

Silver Iodobromide Emulsion A containing 6 mole % silver iodide (containing 0.35 mole of silver halide and 40 g of gelatin per kilogram of the monodisperse emulsion ($s/\bar{r}=15\%$) of an average silver halide particle size of $0.3\mu$) was prepared in usual manner. One kilogram of this emulsion was chemically sensitized by use of a gold sensitizer and a sulfur sensitizer. To this were then added green-sensitizing dyes anhydro-5,5'-dichloro-9-ethyl-3,3'-di(3-sulfopropyl)oxacarbocyaninehydroxide and anhydro-5,5'-diphenyl-9-ethyl-3,3'-di-(3-sulfopropyl)oxacarbocyaninehydroxide, and then 0.25 g of 4-hydroxy-6-methyl-1,3,3a,7-tetrazaindene and 20 mg of 1-phenyl-5-mercaptotetrazole.

On the other hand, Silver Iodobromide Emulsion B containing 6 mole % silver iodide (containing 0.35 mole of silver halide and 40 g of gelatin per kilogram of the monodisperse emulsion ($s/\bar{r}=15\%$) of an average silver halide particle size of $0.6\mu$) was prepared in usual manner. This emulsion was then separately sensitized in the same manner as and by use of one half of the quantities of the same sensitizers and stabilizers as those used in Emulsion A.

The above sensitized Emulsions A and B were then mixed in a proportion of 1 to 1. This mixed emulsion was divided into six parts, and to each part of the emulsion were added separately 500 ml each of the following dispersed materials [(M-1)], [(M-2)], [(M-3)], [(M-4)], [(M-5)], and [(M-6)], per kilogram of the same emulsion to thereby prepare six green-sensitized, low-speed silver halide emulsion samples. Each emulsion was coated on a cellulose triacetate film support s that the coated amount of silver is 18 mg/dm$^2$, whereby Samples 11, 12, 13, 14, 15 and 16 were prepared. The dispersed liquids for use in preparing the above samples were prepared as follows:

Dispersed Material [(M-1)]

Twenty grams of a magenta coupler 1-(2,4,6-trichlorophenyl)3-[3-(2,4-di-(t-amylphenoxyacetamido)-benzamido]-5-pyrazolone (M-1) and 5 g of a colored magenta coupler 1-(2,4,6-trichlorophenyl)-4(1-naphthylazo)-3-(2-chloro-5-octadecenylsuccinimidoanilino)-5-pyrazolone (CM-2) were dissolved into a mixture of 25 g of tricresyl phosphate (TCP) and 100 ml of ethyl acetate. This solution was then added to 300 ml of an aqueous 7.5% gelatin solution containing 4 g of sodium triisopropylnaphthalenesulfonate. The mixture was then emlsified to be dispersed by means of a colloid mill, and the obtained dispersed liquid was made to 500 ml.

Dispersed Material [(M-2)]

This was prepared in the same manner as in Dispersed Material [(M-1)] except that 1 g of Exemplified Compound (S-1) was added.

Dispersed Material [(M-3)]

This was prepared in the same as in Dispersed Material [(M-1)] except that 1 g of Exemplified Compound (S-4) was added.

Dispersed Material [(M-4)]

Twenty grams of Magenta Polymer Coupler (P-13) and 5 g of Colored Magenta Coupler (CM-2) were dissolved into a mixture of 3 g of TCP and 100 ml of EA. This solution was added to 300 ml of an aqueous 7.5% gelatin solution containing 4 g of sodium triisopropylnaphthalenesulfonate. The resulting mixture was emulsified to be dispersed by a colloid mill, and the obtained dispersed liquid was made to 500 ml.

Dispersed Material [(M-5)]

This was prepared in the same manner as in Dispersed Material [(M-4)] except that 1 g of Exemplified Compound (S-1) was added.

Dispersed Material [(M-6)]

This was prepared in the same manner as in Dispersed Material [(M-4)] except that 1 g of Exemplified Compound (S-4) was added.

Each of these coated samples was subsequently exposed through an optical wedge to a green light, and then processed in accordance with the following procedure, whereby dye-image formed samples were obtained.

| Processing Steps | Processing Period |
|---|---|
| Color developing | 3 min. & 15 sec. |
| Bleaching | 6 min. & 30 sec. |
| Washing | 3 min. & 15 sec. |
| Fixing | 6 min. & 30 sec. |
| Washing | 3 min. & 15 sec. |
| Stabilizing | 1 min. & 30 sec. |

The processing liquid compositions used in the above processing steps are as follows:

| | |
|---|---|
| Color Developer: | |
| 4-amino-3-methyl-N—ethyl-N(β-hydroxyethyl)-amino sulfate | 4.8 g |
| Anhydrous sodium sulfite | 0.14 g |
| Hydroxyamine ½ sulfate | 1.98 g |
| Sulfuric acid | 0.74 g |
| Anhydrous potassium carbonate | 28.85 g |
| Anhydrous potassium hydrogencarbonate | 3.46 g |
| Anhydrous potassium sulfite | 5.10 g |
| Potassium bromide | 1.16 g |
| Sodium chloride | 0.14 g |
| Trisodium nitrilotriacetate, monohydrated | 1.20 g |
| Potassium hydroxide | 1.48 g |
| Water to make 1 liter | |
| Bleaching Bath: | |
| Iron-ammonium ethylenediaminetetracetate | 100.0 g |
| Diammonium ethylenediaminetetracetate | 10.0 g |
| Ammonium bromide | 150.0 g |
| Glacial acetic acid | 10.0 ml |
| Water to make 1 liter. Use aqueous ammonia to adjust the pH to 6.0 | |
| Fixer: | |
| Ammonium thiosulfate | 175.0 g |
| Anhydrous sodium sulfite | 8.6 g |
| Sodium metabisulfite | 2.3 g |
| Water to make 1 liter. Use acetic acid to adjust the pH to 6.0 | |
| Stabilizer: | |
| Formalin | 1.5 ml |
| Koniducks (manufactured by Konishiroku Photo Industry. Co., Ltd.) | 7.5 ml |
| Water to make 1 liter. | |

The photographic characteristics of the formed color image were measured. The obtained results are as given in Table 1. In the table, the speed of each sample was indicated in the relative speed form.

TABLE 1

| Sample No. | Dispersed material added to EM layer | Fog | Maximum density | Relative speed | |
|---|---|---|---|---|---|
| 11 | [(M-1)] | 0.22 | 1.80 | 100 | Comparative |
| 12 | [(M-2)] | 0.21 | 1.83 | 102 | " |
| 13 | [(M-3)] | 0.20 | 1.81 | 98 | " |
| 14 | [(M-4)] | 0.21 | 1.82 | 100 | " |
| 15 | [(M-5)] | 0.16 | 2.16 | 148 | Invention |
| 16 | [(M-6)] | 0.17 | 2.10 | 144 | " |

As is apparent from Table 1, the samples of the invention show smaller fog and higher color density and speed than do the comparative samples. Thus the samples of the invention are largely improved on the characteristics.

EXAMPLE-2

On a cellulose triacetate film support the following layers, changing the combination of the coupler with Compound [I] in the especially problematic green-sensitive magenta color-forming layer, were coated in order from the support side, whereby Samples 21 to 26 were prepared.

Layer-1: Red-sensitive low-speed silver halide emulsion layer

A silver iodobromide emulsion containing 6 mole % silver iodide (containing 0.35 mole of silver halide and 40 g of gelatin per kilogram of the emulsion of an average particle size of 0.6μ) was prepared in usual manner. One kilogram of this emulsion was chemically sensitized by a gold sensitizer and a sulfur sensitizer. And to this were then added red-sensitizing dyes anhydro-9-ethyl-3,3'-di-(3-sulfopropyl)-4,5,4',5'-dibenzothiacarbocyaninehydroxide and anhydro-5,5'-dichloro-9-ethyl-3,3'-di-(3-sulfopropyl)thiacarbocyaninehydroxide, and then 0.25 g of 4-hydroxy-6-methyl-1,3,3a,7-tetrazaindene and 20 mg of 1-phenyl-5-mercaptotetrazole, and further 500 ml of the following Dispersed Material [(C-1)]. The thus obtained red-sensitive low-speed silver halide emulsion was coated so that the coated amount of silver is 25 mg/dm$^2$.

Layer-2: Red-sensitive high-speed silver halide emulsion layer

A silver iodobromide emulsion containing 6 mole % silver iodide (containing 0.35 mole of silver halide and 30 g of gelatin per kilogram of the emulsion of an average particle size of 1.2μ) was prepared in usual manner. On kilogram of this emulsion was chemically sensitized by the addition of a gold sensitizer and a sulfur sensitizer. To this were then added red-sensitizing dyes anhydro-9-ethyl-3,3'-di-(3-sulfopropyl)-4,5,4',5'-di-benzothiacarbocyaninehydroxide and anhydro-5,5'-dichloro-9-ethyl-3,3'-di-(3-sulfopropyl)thiacarbocyaninehydroxide and 0.25 g of 4-hydroxy-6-methyl-1,3,3a,7-tetrazaindene and 8 mg of 1-phenyl-5-mercaptotetrazole, and further added 500 ml of the following Dispersed Material [(C-2)]. The thus obtained red-sensitive high-speed silver halide emulsion was coated so that the coated amount of silver is 18 mg/dm$^2$. In addition, the dispersed materials used for the above emulsion layers were prepared as follows:

Dispersed Material [(C-1)]

Twenty-five grams of a cyan coupler 1-hydroxy-N-[8-(2,4-di-t-amylphenoxy)butyl]-2-naphthamide (C-1)

and 2 g of a colored cyan coupler disodium 1-hydroxy-4-[4-(1-hydroxy-8-acetamido-3,6-disulfo-2-naphthylazo)phenoxyl]-N-[8-(2,4-di-t-amylphenoxy)butyl]-2-naphtha mi de (CC-2) were dissolved by heating into a mixture of 30 g of TCP and 140 ml of EA. This solution was then added to 300 ml of an aqueous 7.5% gelatin solution containing 4 g of sodium triisopropylnaphthalenesulfonate. This mixture was then emulsified to be dispersed by means of a colloid mill, and the obtained dispersed liquid was then made to 500 ml.

Dispersed Material [(C-2)]

Five grams of a cyan coupler 1-hydroxy-4-[β-methoxyethylaminocarbonylmethoxy)]-N-[8-(2,4,-di-t-amylphenoxy)butyl]-2-naphthamide (C-2) were dissolved by heating into a mixture of 10 g of TCP and 20 ml of EA. This solution was added to an aqueous 7.5% gelatin solution containing 2 g of sodium triisopropylnaphthalenesulfonate, and the resulting mixture was emulsified to by dispersed by means of a colloid mill, and then made to 500 ml.

Layer-3: Interlayer

An aqueous gelatin solution was coated so that the coated amount of the gelatin is 8 mg/dm$^2$.

Layer-4: Green-sensitive low-speed silver halide emulsion layer

A silver iodobromide emulsion containing 6 mole% silver iodide (containing 0.35 mole of silver halide and 40 g of gelatin per kilogram of the emulsion of an average particle size of 0.3μ) was prepared in usual manner. One kilogram of this emulsion was chemically sensitized by use of a gold sensitizer and a sulfur sensitizer. To this were then added green-sensitizing dyes anhydro-5,5'-dichloro-9-ethyl-3,3'-di-(3-sulfopropyl)oxacarbocyaninehydroxide and anhydro-5,5'-diphenyl-9-ethyl-3,3'-di-(3-sulfopropyl)oxacarbocyaninehydroxide, and 0.25 g of 4-hydroxy-6-methyl-1,3,3a,7-tetrazaindene and 20 mg of 1-phenyl-5-mercaptotetrazole. The thus prepared emulsion was regarded as Sensitized Emulsion A'. On the other hand, a silver iodobromide emulsion containing 6 mole % silver iodide (containing 0.35 mole of silver halide and 40 g gelatin per kilogram of the emulsion of an average silver halide particle size of 0.6μ) was prepared in usual manner, and this emulsion was then sensitized in the same manner by use of the same sensitizers and stabilizers as in Sensitized Emulsion A', provided that the quantities of the sensitizers and stabilizers are one half of those used in Sensitized Emulsion A'. The resulting emulsion was regarded as Sensitized Emulsion B'. Sensitized Emulsions A' and B' were mixed in a proportion of 1 to 1.

The mixed emulsion was divided into six parts. The 1 kg of each part of the emulsion were added 500 ml each of the following Dispersed Materials [(M-1)], [(M-2)], [(M-3)'], [(M-4)'], [(M-5)'], and [(M-6)'] to thereby prepare six green-sensitive low-speed silver halide emulsions. The emulsions each was coated so that the coated amount of silver is 18 mg/dm$^2$, whereby Samples 21 to 26 were prepared, provided the amount of the gelatin used in each sample of 24 to 26 was reduced from 40 g to 20 g. The dispersed materials used for these samples were prepared as follows:

Dispersed Materials [(M-1)] and [(M-2)]

These are as defined previously.

Dispersed Materials [(M-3)']

This was dispersed to be prepared in the same manner as Dispersed Materials [(M-1)] except that 1 g of Exemplified Compound (S-3).

Dispersed Materials [(M-4)']

Twenty grams of Magenta Polymer Coupler (P-15) and 5 g of Colored Magenta Coupler (CM-2) were dissolved into a mixture of 3 g of TCP with 100 ml of EA. This solution was then added to 300 ml of an aqueous 3.75% gelatin solution containing 4 g of sodium triisopropylnaphthalenesulfonate. The resulting mixture was then emulsified to be dispersed by means of a colloid mill, and the whole quantity was made to 500 ml.

Dispersed Material [(M-5)']

This was dispersed to be prepared in the same manner as in Dispersed Material [(M-4)'] except that 1 g of Exemplified Compound (S-1) was added.

Dispersed Material [(M-6)']

This was dispersed to be prepared in the same manner as in Dispersed Material [(M-4)'] except that 1 g of Exemplified Compound (S-3) was added.

Layer-5: Green-sensitive high-speed silver halide emulsion layer

A silver iodobromide emulsion containing 6 mole % silver iodide (containing 0.35 mole of silver halide and 30 g of gelatin per kilogram of the emulsion of an average silver halide particle size of 1.2μ) was prepared in usual manner. One kilogram of this emulsion was cheically sensitized by use of a gold sensitizer and a sulfur sensitizer. To this were then added green-sensitizing dyes, the same compounds as those used in the green-sensitive low-speed silver halide emulsion, and further 0.25 g of 4-hydroxy-6-methyl-1,3,3a,7-tetrazaindene and 5 mg of 1-phenyl-5-mercaptotetrazole. To the emulsion were further added 200 ml of the following Dispersed Material [(M-7)] to thereby prepare a green-sensitive high-speed silver halide emulsion, which was then coated so that the coating amount of silver is 12 mg/dm$^2$. The dispersed material used in the above emulsion was prepared as follows:

Dispersed Material [(M-7)]

Six grams of magenta Coupler (M-1) and 2 g of Colored Magenta Coupler (CM-2) were dissolved into a mixture of 10 g of TCP with 40 ml of EA. This solution was added to 100 ml of an aqueous 7.5% gelatin solution containing 2 g of triisopropylnaphthalenesulfonate. The resulting mixture was then emulsified to be dispersed by means of a colloid mill, and the whole quantity was made to 200 ml.

Layer-6: Yellow filter layer

A gelatin solution containing an yellow colloidal silver and 2,5-di-tert-octylhydroquinone was coated so that the coated amount of the gelatin is 8 mg/dm$^2$.

Layer-7: Blue-sensitive low-speed silver halide emulsion layer

A silver iodobromide emulsion containing 6 mole % silver iodide (containing 0.35 mole of silver halide and 40 g of gelatin per kilogram of the emulsion of an average silver halide particle size of 0.6μ) was prepared in usual manner. One kilogram of this emulsion was chemically sensitized by use of a gold sensitizer and a sulfur sensitizer. To this were then added an blue-sensitizing dye anhydro-3,3'-di-(3-sulfopropyl)-selenacyaninehydroxide, and further 0.25 g of 4-hydroxy-6-methyl-1,3,3a,7-tetrazaindene and 20 mg of 1-phenyl-5-mercaptotetrazole. To this emulsion were further added 1000 ml of the following Dispersed Material [(Y-1)] to thereby prepare a blue-sensitive low-speed silver halide emulsion layer, which was then coated so that the coated amount of silver is 6 mg/dm$^2$. The dispersed material used for preparing the above emulsion was prepared as follows:

Dispersed Material [(Y-1)]

One-hundred grams of α-(1-benzyl-2-phenyl-3,5-dioxo-1,2,4-triazolidinyl)]-α-pivalyl-2-chloro-5-[8-(2,4-di-t-amylphenoxy)butylamido]acetanilide were dissolved into a mixture of 100 g of TCP with 300 ml of EA. This solution was added to 400 ml of an aqueous 7.5% gelatin solution containing 8 g of sodium triisopropylnaphthalenesulfonate. This mixture was emulsified to be dispersed by means of a colloid mill, and the whole quantity was made to 1000 ml.

Layer-8: Blue-sensitive high-speed silver halide emulsion layer

A silver iodobromide emulsion containing 6 mole % silver iodide (containing 0.35 mole of silver halide and 30 g of gelatin per kilogram of the emulsion of an average silver halide particle size of 1.2μ) was prepared in usual manner. One kilogram of this emulsion was chemically sensitized by use of a gold sensitizer and a sulfur sensitizer. To this were then added a blue-sensitizing dye anhydro-3,3'-di-(3-sulfopropyl)selenacyaninehydroxide, 0.25 g of 4-hydroxy-6-methyl-1,3,3a,7-tetrazaindene and 5 mg of 1-phenyl-5-mercaptotetrazole, and further 400 ml of the following Dispersed Material [(Y-2)] to thereby prepare a blue-sensitize high-speed silver halide emulsion, which was then coated so that the coated amount of silver is 5 mg/dm$^2$.

The dispersed material used for the above emulsion was prepared as follows:

Dispersed Material [(Y-2)]

Thirty grams of the same yellow coupler as that used in Layer-7 was dissolved into a mixture of 30 g of TCP with 100 ml of EA. This solution was added to 200 ml of an aqueous 7.5% gelatin solution containing 4 g of sodium triisopropylnaphthalenesulfonate. This mixture was then emulsified/dispersed by means of a colloid mill, and the whole quantity was made to 400 ml.

Layer-9: Interlayer

An aqueous gelatin solution was coated so that the coated amount of the gelatin is 8 mg/dm$^2$.

Layer-10: Protective layer

An aqueous gelatin solution containing silica of an average particle size of 5u as a matting agent was coated so that the coated amount of the gelatin is 6 mg/dm$^2$.

The thus prepared high-speed multi-layer color negative light-sensitive materials each was exposed through an optical wedge to white light, and then processed in the same manner as in Example-1. The image formed on each of these processed samples was measured with respect to the photographic characteristics and image sharpness. The measured results are as given in Table 2.

TABLE 2

| Sample No. | Dispersed material added to Layer-4 | Characteristics of magenta color forming layer | | | | | |
|---|---|---|---|---|---|---|---|
| | | Fog | maximum density | Relative speed | MTF (%) 10 lines /mm | MTF (%) 30 lines /mm | |
| 21 | [(M-1)] | 0.64 | 2.36 | 100 | 105 | 48 | Comparative |
| 22 | [(M-2)] | 0.65 | 2.33 | 99 | 112 | 50 | " |
| 23 | [(M-3)'] | 0.65 | 2.34 | 101 | 108 | 47 | " |
| 24 | [(M-4)'] | 0.63 | 2.38 | 102 | 116 | 67 | " |
| 25 | [(M-5)'] | 0.56 | 2.58 | 153 | 116 | 68 | Invention |
| 26 | [(M-6)'] | 0.55 | 2.55 | 148 | 118 | 72 | " |

As is apparent from Table 2, the samples of the invention show lower fog and higher color density and speed than do the comparative samples. Further the samples of the invention is largely improved on the image sharpness. The improvement of the sharpness is considered due to the reduction of the amount of the gelatin in Samples 24, 25 and 26 by half that of Samples 21 to 23. In Samples 21 to 23, wherein ordinary oil-protected magenta couplers were used, when the amount of the gelatin was reduced by half, the sweating phenomenon appeared so conspicuously that the photographic characteristics were hardly evaluated.

In addition, the improvement effect on the image sharpness was evaluated by the comparison between the magnitudes of MTF (Modulation Transfer Furction) found at spatial frequencies of 10 lines/mm and 30 lines/mm.

What is claimed is:

1. A silver halide color photographic light-sensitive material comprising a support having thereon at least one silver halide emulsion layer wherein said layer contains a polymer coupler and a compound having the following general formula:

$$Ar\text{-}(O\text{—}RO)_pH \qquad [I]$$

wherein Ar is an aryl group, R is an alkylene group, and p is an integer from 1 to 3.

2. The material of claim 1 wherein said cyan coupler monomer has the following Formula [III] or [IV]:

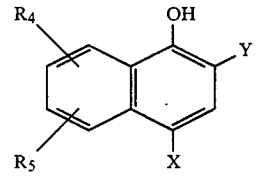

[III]

-continued

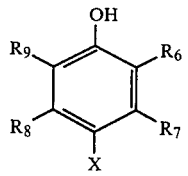

[IV]

wherein $R_4$ is a hydrogen atom or a methyl group; A is a divalent group of —NH— or —O—; X is a group that splits off during the coupling reaction with the oxidized product of an aromatic primary amine developing agent; $R_5$ is a hydrogen, alkyl or alkoxy having from 1 to 4 carbon atoms, halogen, sulfo, carboxy, sulfonamide, carbamoyl, sulfamoyl or cyano; Y is a group containing a polymerizable vinyl group; $R_7$ is the same as the $R_4$; $R_9$ is the same as the $R_5$; $R_6$ and $R_8$ are each hydrogen, alkyl or alkoxy having from b 1 to 8 carbon atoms, halogen, sulfo, alkyl carbamoyl, aryl carbamoyl, carboxy, sulfamoyl, or —NH—L wherein L is alkylcarbonyl, arylcarbonyl, alkylsulfonyl, arylsulfonyl, alkoxycarbonyl, acryloylamino, methacryloylamino, acryloyloxy, or methacryloyloxy group, provided that at least one of $R_6$ and $R_8$ is a group containing a polymerizable vinyl group.

3. The material of claim 1 wherein p is 1 or 2.

4. The silver halide color photographic light-sensitive material as claimed in claim 1, wherein said polymer coupler is obtained by polymerizing a yellow coupler monomer, a cyan coupler monomer or a magenta coupler monomer.

5. The silver halide color photographic light-sensitive material as claimed in claim 4, wherein said yellow coupler monomer has the following Formula [II]:

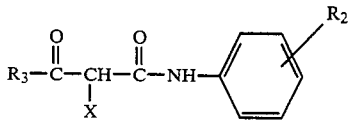

[II]

wherein $R_2$ is a hydrogen atom or an alkyl or alkoxy group having from 1 to 4 carbon atoms, a halogen atom, a sulfo, carboxy, sulfonamide, carbamoyl, sulfamoyl or cyano group; $R_3$ is an alkyl or aryl group; X is a group that slits off during the coupling reaction with oxidized product of an aromatic primary amine developing agent, provided that the yellow coupler monomer having Formula [II] contains, in an arbitrary position thereof, a group containing a polymerizable vinyl group.

6. The silver halide color photographic light-sensitive material as claimed in claim 4, wherein the magenta coupler monomer has the following Formula [V]:

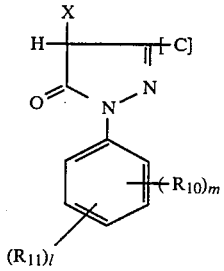

[V]

wherein X is a group that splits off during the coupling reaction with the oxidized product of an aromatic primary amine developing agent; $R_{10}$ is a hydrogen atom or an alkyl or alkoxy group having from 1 to 4 carbon atoms, a sulfo, carboxy, sulfonamide, carbamoyl, sulfamoyl or cyano group; $R_{11}$ is a hydrogen atom, alkyl or alkoxy group having from 1 to 8 carbon atoms, a halogen atom, a sulfo, alkylcarbamoyl, arylcarbamoyl, carboxy, sulfamoyl group, —NH—L group wherein L is alkylcarbonyl, arylcarbonyl, alkylsulfonyl, arylsulfonyl or alkoxycarbonyl group, acryloxlamino, methacryloxlamino, acryloyloxy or methacryloyloxy group; [C] is as defined in the $R_{11}$ or

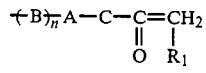

wherein $R_1$ is a hydrogen atom or a methyl group; $R_2$ is a hydrogen atom or an alkyl or alkoxy group having from 1 to 4 carbon atoms, a halogen atom, a sulfo, carboxy, sulfonamide, carbamoyl, sulfamoyl or cyano group; A is a divalent group of —NH— or —O—; B is a divalent organic group; and n is 0 or 1, provided that at least one of the [C] and $R_{11}$ is a group containing a polymerizable vinyl group.

7. The silver halide color photographic light-sensitive material as claimed in claim 5, wherein the group containing a polymerizable vinyl group has the following formula:

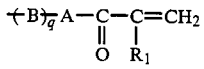

wherein $R_1$ is a hydrogen atom or a methyl group; A is a divalent group of —NH— or —O—; B is a divalent organic group; and q is 0 or 1.

8. The silver halide color photographic light-sensitive material as claimed in claim 2, wherein the group Y has the following formula:

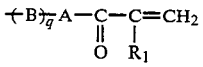

wherein $R_1$ is a hydrogen atom or a methyl group; A is a divalent group of —NH— or —O—; B is a divalent organic group; and q is 0 or 1.

9. The silver halide color photographic light-sensitive material as claimed in claim 6, wherein the group containing a polymerizable vinyl group has the following formula:

$$\text{-}(B)_q\text{-}A\text{-}\underset{\underset{O}{\|}}{C}\text{-}\underset{\underset{R_1}{|}}{C}{=}CH_2$$

wherein $R_1$ is a hydrogen atom or a methyl group; A is a divalent group of —NH— or —O—; B is a divalent organic group; and q is 0 or 1.

10. The silver halide color photographic light-sensitive material as claimed in claim 5, wherein at least one of the X, the $R_3$ and the phenyl group having the $R_2$ as a substituent of Formula [II] have said group containing a polymerizable vinyl group.

11. The silver halide color photographic light-sensitive material as claimed in claim 6, wherein Y has the following formula:

$$\text{-}\underset{\underset{O}{\|}}{C}\text{-}NH\text{-}(B)_n\text{-}A\text{-}\underset{\underset{O}{\|}}{C}\text{-}\underset{\underset{R_1}{|}}{C}{=}CH_2$$

wherein A, B, $R_1$ and n are as defined in the formula of claim 6.

12. The silver halide color photographic light-sensitive material as claimed in claim 3, the $$\text{-}(B)_n\text{-}A\text{-}\underset{\underset{O}{\|}}{C}\text{-}\underset{\underset{R_1}{|}}{C}{=}CH_2$$

represented by [C] has the following formula:

$$\text{-}NH\text{-}(B)_n\text{-}A\text{-}\underset{\underset{O}{\|}}{C}\text{-}\underset{\underset{R_1}{|}}{C}{=}CH_2$$

wherein A, B, $R_1$ and n are as defined in claim 5.

13. The silver halide color photographic light-sensitive material as claimed in claim 3, wherein B is an alkylene group having from 1 to 12 carbon atoms, an arylene group having from 6 to 12 carbon atoms, an arylene-alkylene group having 7 to 24 carbon atoms, an arylene-bisalkylene group having from 8 to 32 caron atoms or an alkylene-bisarylene group having from 13 to 34 carbon atoms.

14. The silver halide color photographic light-sensitive material as claimed in claim 7, wherein B is an alkylene group having from 1 to 12 carbon atoms, an arylene group having from 6 to 12 carbon atoms, an arylene-alkylene group having 7 to 24 carbon atoms, an arylene-bisalkylene group having from 8 to 32 carbon atoms or an alkylene-bisarylene group having from 13 to 34 carbon atoms.

15. The silver halide color photographic light-sensitive material as claimed in claim 8, wherein B is an alkylene group having from 1 to 12 carbon atoms, an arylene group having from 6 to 12 carbon atoms, an arylene-alkylene group having 7 to 24 carbon atoms, an arylene-bisalkylene group having from 8 to 32 carbon atoms or an alkylene-bisarylene group having from 13 to 34 carbon atoms.

* * * * *

UNITED STATES PATENT AND TRADEMARK OFFICE

CERTIFICATE OF CORRECTION

PATENT NO. : 4,576,909

DATED : March 18, 1986

INVENTOR(S) : Goto, et al

It is certified that error appears in the above-identified patent and that said Letters Patent is hereby corrected as shown below:

Column 32, line 55, change "Ar $\leftarrow$O-RO)pH" to --Ar-O $\leftarrow$RO)pH--.

Column 32, line 59, change "1" to --4--.

Signed and Sealed this

Twenty-first Day of May, 1991

*Attest:*

HARRY F. MANBECK, JR.

*Attesting Officer*

*Commissioner of Patents and Trademarks*